United States Patent [19]

Aoki et al.

[11] 4,103,731

[45] Aug. 1, 1978

[54] SHAKE-OUT MACHINE FOR USE WITH SELF-CURING MOLD

[75] Inventors: Shunichi Aoki; Eiji Maeda, both of Shimizu, Japan

[73] Assignee: Hitachi, Ltd., Japan

[21] Appl. No.: 767,889

[22] Filed: Feb. 11, 1977

[30] Foreign Application Priority Data

| | | | |
|---|---|---|---|
| Feb. 18, 1976 | [JP] | Japan | 51-57812 |
| Feb. 18, 1976 | [JP] | Japan | 51-17203[U] |
| Feb. 27, 1976 | [JP] | Japan | 51-21611[U] |
| Apr. 23, 1976 | [JP] | Japan | 51-50061[U] |

[51] Int. Cl.[2] ..... B22D 29/00

[52] U.S. Cl. ..... 164/147; 164/154; 164/401

[58] Field of Search ..... 164/147, 401, 404, 344, 164/131, 154; 425/444

[56] References Cited

U.S. PATENT DOCUMENTS

| | | | |
|---|---|---|---|
| 2,525,572 | 10/1950 | Woody et al. | 164/404 |
| 3,259,946 | 7/1966 | Blue | 164/344 |
| 3,284,861 | 11/1966 | Ivarsson | 164/401 |
| 3,930,778 | 1/1976 | Roncelli | 425/444 |

*Primary Examiner*—Francis S. Husar
*Assistant Examiner*—John McQuade
*Attorney, Agent, or Firm*—Craig & Antonelli

[57] ABSTRACT

A shake-out machine for use with a self-curing mold which includes a body having a bridge-shaped frame and hydraulic cylinder device provided with downwardly directed plungers disposed on top of a ceiling portion of said frame. A mold feeding means arrangement is provided with a wheeled panel serving as a supporting mount for a molding flask during the shake-out operation. The wheeled panel is provided with an opening and is adapted to be run along rails laid on a floor so as to transport the mold under the plungers. A dropped material delivery device, including a wheeled panel capable of running on rails laid on a bottom portion of a pit, is provided with a delivery box mounted on the wheeled panel. The hydraulic cylinder device is equipped with plungers which are operable independently of each other, whereby desired plungers in said hydraulic cylinder device may be lowered by an amount commensurate with the size of a molding flask.

11 Claims, 9 Drawing Figures

SHAKE-OUT MACHINE FOR USE WITH SELF-CURING MOLD

BACKGROUND OF THE INVENTION

This invention relates to a shake-out or knockout machine for use with a self-curing mold, and more particularly to a shake-out machine which is generally applicable to a shake-out operation for self-curing molds placed in various types and sizes of molding flasks.

This type shake-out machine consists of a body, a molding flask feeding means and a delivery means for delivering materials which have been dropped or knocked out from a molding flask.

Hitherto, an air cylinder machine or a hydraulic cylinder machine having a single plunger is used as a shake-out machine in a mass production line for a given size of molding flasks, irrespective of the types of molds, i.e., a green-sand mold having a relatively low retained-strength of sand and a self-curing mold having a relatively high retained-strength.

U.S. Pat. No. 2,525,572 which is a prior art for the present invention discloses a shake-out machine provided with two punch-out cylinders. This type shake-out machine however has to be subject to limitations arising from the size of a molding flask as well as from a limited number of plungers used (two in number) when used for self-curing molds having a high retained strength of sand. The machine has to be used exclusively for a specific size of molding flasks.

OBJECTS OF THE INVENTION

It is the first object of the present invention to provide a shake-out machine which is well adapted for use in a shake-out operation for exothermic, self-curing molds having a high retained strength such as, for example, an inorganic self-curing mold made of water-glass and silicon powder or an organic self-curing mold.

It is the second object of the present invention to provide a shake-out machine which is applicable to shake-out operations for various type and size molding flasks, and particularly to castings of various types and a small amount.

It is the third object of the present invention to provide a shake-out machine provided with a load reducing means for minimizing a load acting on wheels of a wheeled panel and rails for the wheeled panel which carries a mold thereon, during the shake-out operation. The minimization of the load acting on wheels of the wheeled panel and support rails is desirable because, in the shake-out operation, a wheeled panel in a mold feeding means supports a molding flask thereon, and thus when a mold is pressed by a plunger in a hydraulic cylinder means adapted for use in the shake-out operation, a considerable load is applied to wheels of the wheeled panel, as well as on rails therefor. By virtue of the load applied to the wheels and rails, it has been necessary to use a wheeled panel having wheels and rails of a strong construction accommodating the severe load.

It is the fourth object of the present invention to provide a shake-out machine provided with a shock absorbing means adapted to absorb an impact on a delivery box in a dropped material delivering means adapted to receive and carry a casting and casting sand which have been knocked out.

The provision of a shock absorbing means is desirable because, when a casting and collapsed sand drop from a considerable height into a delivery box positioned in a pit in a bottom portion of the machine, the delivery box and a casting undergo a large impact with the impact leading to a cracking or deformation in a casting or delivery box.

SUMMARY OF THE INVENTION

The first object of the present invention may be attained in a shake-out machine wherein a bridge-shaped frame is mounted in an upwardly projecting relation on a base having an opening, with a plural number of hydraulic cylinders being provided on the frame each housing downwardly directed plungers, whereby desired plungers may be lowered by an amount commensurate with the size of a molding flask which has been brought under the plungers.

In addition, the shake-out machine includes a hydraulic circuit in which fluid passages leading to upper chambers and lower chambers in pistons housed in respective hydraulic cylinders are connected to flow-path-switching electromagnetic valves, on one side thereof respectively, while other fluid passages leading to a hydraulic pump and an oil reservoir are connected to the other side of the flow-path-switching electromagnetic valves, whereby when the electromagnetic valves are de-energized, the electromagnetic valves close passages connected thereto, and when the electromagnetic valves are energized, then a hydraulic pressure is supplied to the upper chambers in the hydraulic cylinders, while the lower chambers are communicated with the oil reservoir for bleeding oil therefrom. In addition, when plungers are lowered to their bottom dead centers, then the electromagnetic valves detect a hydraulic pressure acting on pressure supply passages through the medium of pressure switches and thereby switch the aforesaid flow pattern to reversed flow pattern. Thus, only flow-path-switching electromagnetic valves associated with hydraulic cylinders which are desired to be operated commensurate with the size of a molding flask may be energized so as to lower desired plungers therefrom.

Furthermore, in case molding flasks of several varying sizes are to be processed, then hydraulic cylinder means are grouped into a desired number of blocks so as to be jointly operated, depending on the size of a molding frame, while fluid passages leading to the upper chambers and lower chambers in hydraulic cylinders are connected to a single flow-path-switching electromagnetic valve for simplifying fluid paths, and in addition, an operation power source circuit for flow-path-switching electromagnetic valves associated with a block to be operated commensurate with the size of a molding flask is connected to a contact of a select switch which corresponds to the size of the molding flask, so that desired hydraulic cylinders commensurate with the size of a molding flask may be operated with the aid of the select switch.

The second object of the present invention is attained in a shake-out machine in which a portion of rails located under plungers is separated from the other portion of rails, with the separated portion of rails being supported in a liftable manner by means of a plural number of cylinders. Supporting frames are positioned outwardly of rails thus separated or inwardly of both the rails therebetween, in opposed relation to the undersurface of a wheeled panel mounting a molding flask thereon, while the aforesaid supporting frames have supporting surfaces adapted to support a wheeled panel, when the separated rail portion is lowered, whereby, when a mold is brought to a shake-out position under the plungers, then a portion of rails thus separated is lowered by cylinder means, with a wheeled panel being supported on the supporting frames, so that a load to be exerted in the shake-out operation may be borne by the supporting frames, thus obviating a load to be applied to the wheels and rails.

The third object of the present invention is attained in a shake-out machine having an impact reducing means in which a plural number of air cylinders are located in the close vicinity of rails on a bottom portion of a pit under the shake-out machine, so that upon an upward stroke of pistons in the cylinder means, the delivery box is lifted from its wheeled panel. Thus, when a wheeled panel carrying a delivery box thereon is introduced to a given position under the plungers within a pit, then the plungers in air cylinders are lifted so as to lift a delivery box from its wheeled panel in a manner that the delivery box may be supported on the plungers in air cylinders. Thus, an impact to be exerted when materials are dropped into the delivery box may be borne by the air cylinder means, thereby preventing wheels and rails from an impact. In this respect, the above impact reducing means includes a dropped-material delivery means.

Alternatively, the delivery box may be of a double wall construction, with a buffer or shock absorbing material filled between its inner and outer walls, so that the delivery box itself may absorb an impact.

The shake-out machine according to the present invention will now be described in more detail with reference to the accompanying drawings which indicate the embodiments of the invention.

Figure 1:
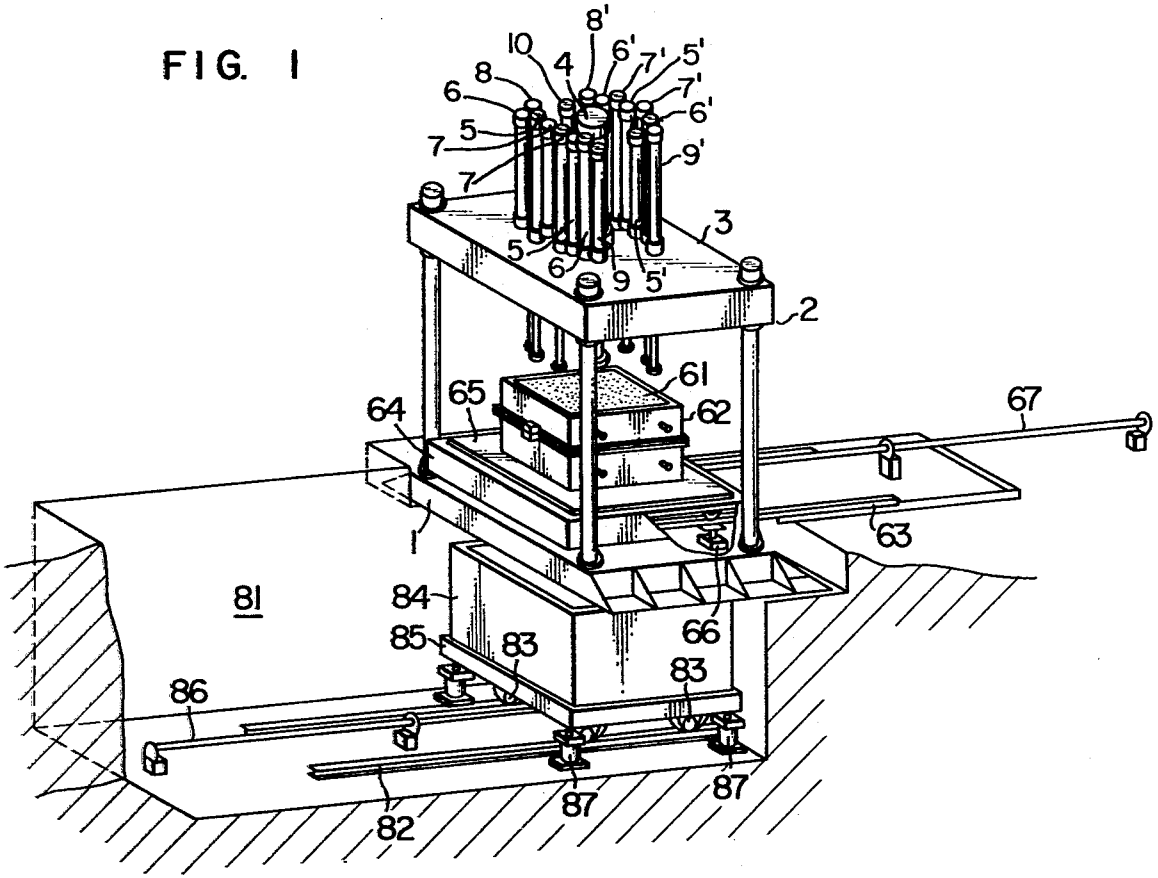
FIG. 1 is a perspective view of an entire shake-out machine embodying the present invention.
Figure 2:
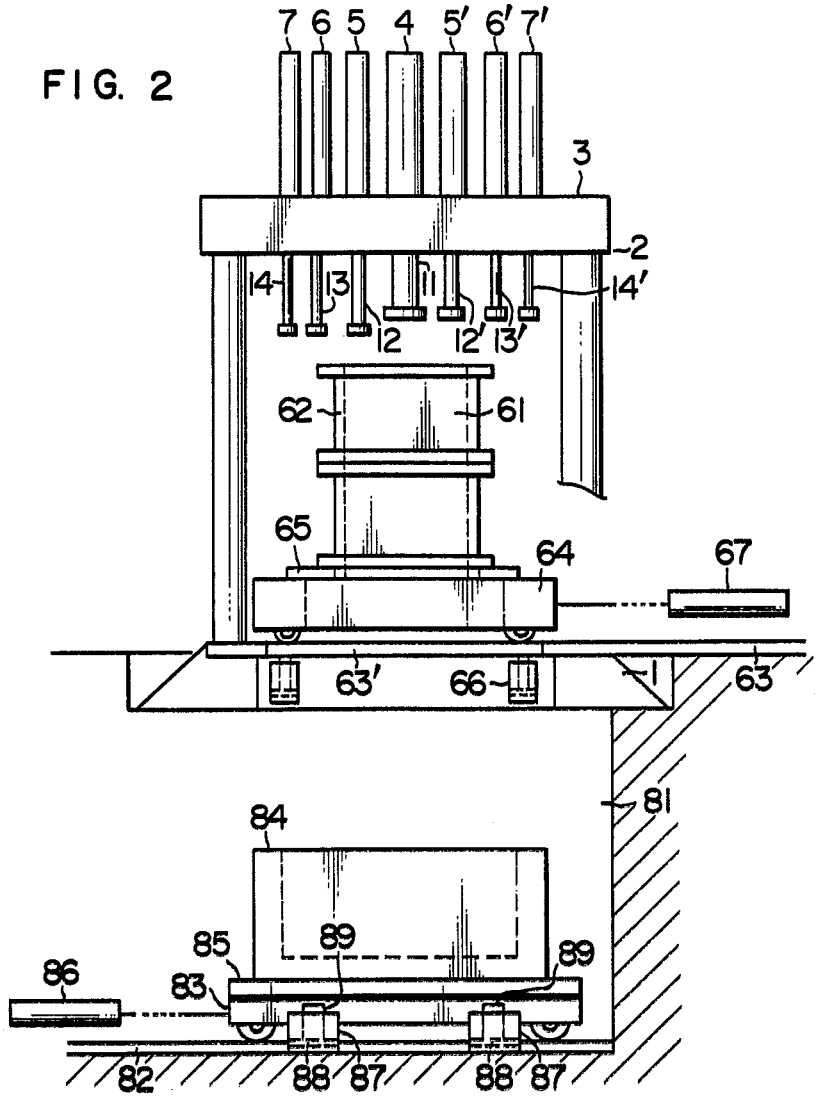
FIG. 2 is a side view of the machine.

A shake-out machine as shown in FIGS. 1 and 2 comprises a body proper having a plural number of plunger adapted to be lowered, a mold or molding flask feeding means disposed thereunder, and a dropped material delivery means disposed in a pit positioned below.

The body proper of the shake-out machine is of such an arrangement that a body member includes a bridge-shaped frame 2 mounted in projecting relation upwards on a base 1 having an opening. A plural number of hydraulic cyinders 4, 5, 5', 6, 6', 7, 7', 8, 8', 9, 9', 10 are provided at positions shown in FIG. 3 on top of an upper frame portion 3 of the bridge-shaped frame 2. The hydraulic cylinders are equipped with plungers 11, 12, 12', 13, 13', 14, 14', 15, 15', 16, 16', 17 adapted to be lowered. The hydraulic cylinders may be operated independently of each other.

The plungers 11, 12, 12', 13, 13', 14, 14', 15, 15', 16, 16', 17 may be operated under a hydraulic pressure so as to press a top portion of a mold 61 brought under the plungers so as to separate sand and a casting from a molding flask 62 for being dropped into a delivery box 84 disposed in a pit 81 positioned therebelow. The hydraulic cylinders 5, 5', 6, 6', 7, 7', 8, 8', 9, 9', 10 are so positioned that the plungers 12, 12', 13, 13', 14, 14', 15, 15', 16, 16', 17 thereof may press substantially the corner portions of molds having varying sizes and kinds, while the central hydraulic cylinder 4 is so positioned that the plunger 11 may press substantially a central portion of the mold 61. As shown most clearly in FIG. 3, pressing pieces *11p, 12p, 12'p, 13', 13'p, 14', 14'p, 15p, 15'p, 16p, 16'p, 17p* are provided at the tips of plungers 11, 12, 12', 13, 13', 14, 14', 15, 15', 16, 16', 17.

A mold feeding means is disposed under the body proper of the shake-out machine. The mold feeding means includes a wheeled panel 64 having an opening and adapted to run on rails 63. The wheeled panel 64 is adapted to mount thereon a mold 61 charged within the molding flask 62 and bring the mold 61 to a shake-out position under the plungers. After the shake-out operation, the wheeled panel 64 delivers the molding flask 62 outside.

A dropped material delivery means is disposed in a pit 81 defined under the mold feeding means. The dropped material delivery means includes a delivery wheeled panel 83 adapted to run on rails 82. A delivery box 84 is placed on the delivery wheeled panel 83 for delivery to the outside of a casting and collapsed sand which have been separated and dropped from the molding flask 62 by means of the plungers positioned thereabove.

Description will now be given of the shake-out operation.

Firstly, the mold 61, prior to a shake-out operation, is mounted through the medium of a mold-supporting plate 65 on a wheeled panel 64, which in turn is brought under the plungers 11, 12, 12', 13, 13', 14, 14', 15, 15', 16, 16', 17 and is rigidly positioned. Then for example, with a molding flask having a configuration such as the flask A in FIG. 3, a hydraulic pressure is introduced into the hydraulic cylinders 4, 5, 5' corresponding to the molding flask 62 to lower the plungers 11, 12, 12', so that the top surface of the mold 61 is pressed with the pressing pieces *11p, 12p, 12'p* provided at the tips of the plungers 11, 12, 12' so as to separate a casting and sand from the molding flask 62.

In this respect, a central portion of the mold 61 is pressed with the plunger 11, while the corner portions thereof are pressed with four plungers 12, 12, 12', 12', so that a casting and sand may be separated or knocked out from the molding flask 62, completely.

The casting and sand thus separated drop into the delivery box 84 disposed thereunder. The delivery box 84 housing the casting and sand therein is delivered out due to the shifting of the wheeled panel 83. Then, the plungers 11, 12, 12' for the hydraulic cylinders 4, 5, 5' are lifted, while the wheeled panel 64 is returned to its home position, thus completing a cycle of the operation.

In case the size of a molding flask is different from that of the molding flask 62, the molding-flask-supporting plate 65 has to be exchanged with a supporting plate accommodating the molding flask concerned. In case the size of a molding flask is particularly large, then the appropriate combustion hydraulic cylinders 6, 6', 7, 7', 8, 8', 9, 9', 10 and associated plungers are operated in addition to the hydraulic cylinders 4, 5, 5', depending on the size of a molding flask in a manner more clearly outlined in a table hereinbelow.

Figure 3:
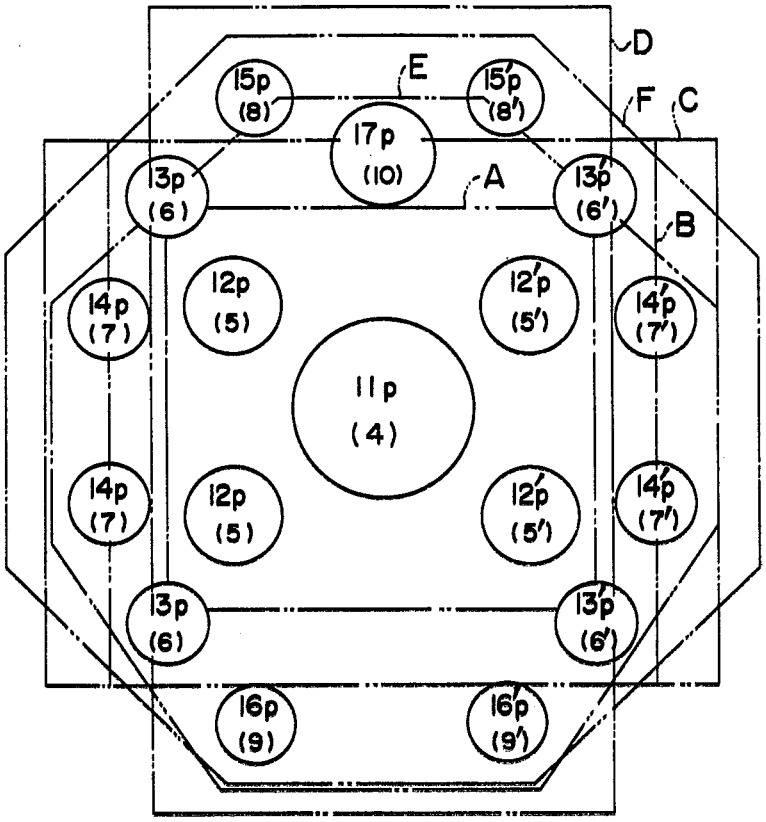
FIG. 3 is a block diagram showing the positional relationship between the plungers in a body proper of a shake-out machine and a molding flask.

In the exemplary arrangement of FIG. 3, eighteen plungers and pressing pieces are provided and are designated 11p to **17*p* with numbers in parentheses denoting the corresponding number of hydraulic cylinders which house the respective plungers. The reference characters A, B, C, D, E, F designate six kinds of molding flasks of varying sizes which are expected to be used. The eighteen hydraulic cylinders 4, 5, 5', 6, 6', 7, 7', 8, 8', 9, 9', 10** may be so designed as to be operated independently of each other. Plungers may be selected, depending on the sizes of molding flasks desired, so as to operate the hydraulic cylinders therefor for a shakeout operation.

The pressing pieces of plungers to be lowered depending on the sizes of molding flasks A to F are shown in the table below:

| Molding flask | Plungers to be lowered |
|---|---|
| A | 11p, 12p, 12p, 12'p, 12'p |
| B | 11p, 12p, 12p, 12'p, 12'p,13p, 13p, 13'p, 13'p |
| C | 11p, 13p, 13p, 13'p, 13'p, 14p, 14p, 14'p, 14'p |
| D | 11p, 12p, 12p, 12'p, 12'p, 15p, 15'p, 16p, 16'p |
| E | 11p, 14p, 14p, 14'p, 14'p, 16p, 16'p, 17p |
| F | 11p, 14p, 14p, 14'p, 14'p, 15p, 15'p, 16p, 16'p |

The selection of the plungers to be lowered depending on the sizes of molding flasks enables a shakeout operation of molds using molding flasks of varying sizes.

A hydraulic circuit for the aforesaid hydraulic cylinders will be described with reference to FIG. 4. The illustrated hydraulic circuit is used for the molding flasks of the seven types, A to F, as shown in FIG. 3.

Figure 4:
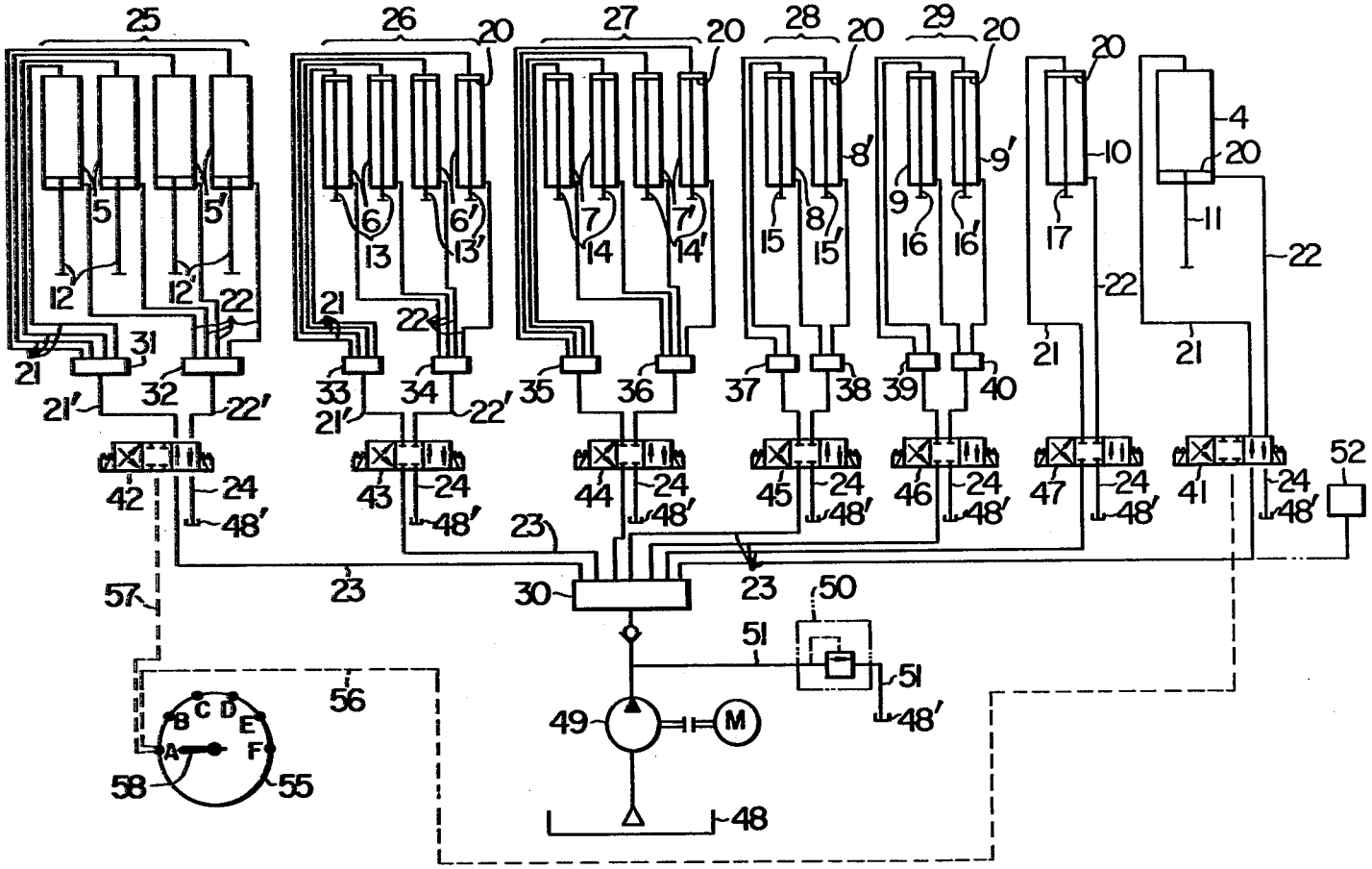
FIG. 4 is a hydraulic circuit diagram for hydraulic cylinders in the body proper of the shake-out machine.

As shown in FIG. 4, hydraulic cylinders 4, 5, 5', 6, 6', 7, 7', 8, 8', 9, 9', 10 house pistons 20 with plungers 11, 12, 12', 13, 13', 14, 14', 15, 15', 16, 16', 17 being connected to respective pistons 20. Pressing pieces are provided on the lower ends of the plungers. The aforesaid hydraulic cylinders are divided into five blocks 25, 26, 27, 28, 29 operable in association with the sizes of molding flasks and hydraulic cylinders 4, 10 which are operated independently.

Pipes 21, 22 are connected to the upper and lower portions of respective hydraulic cylinders with pipes 21, 22 of the blocks 25, 26, 27, 28, 29 being respectively connected to collectors 31-32, 33-34, 35-36, 37-38, 39-40. Flow-path-switching electromagnetic valves 42, 43, 44, 45, 46 are each connected to the collectors 31, 40 by way of pipes 21' and 22'. The pipes 21, 22 for the other hydraulic cylinders 4, 10 are connected to flow-path-switching electromagnetic valves 41, 47, respectively. Connected to the respective electromagnetic valves 41 to 47 at the other ends are pressure supply pipes 23 and pressure discharge pipes 24 with the pressure supply pipes 23 being collected into a hydraulic chamber 30. The oil in an oil reservoir 48 is introduced into a hydraulic pump 49 and is then discharged therefrom under pressure to the hydraulic chamber 30. Each pressure discharge pipe 24 is connected to an oil reservoir 48'. Shown at 50 is a pressure regulating valve which bleeds excessive oil so as to return the oil by way of the pipe 51 to the oil reservoir 48' for adjusting the pressure of oil. Upon de-energization, the flow-path-switching electromagnetic valves 41 to 47 shut off the supply pipes 25 connected to the flow-path-switching electromagnetic valves 43, 44, 45, 46, 47, as shown, for maintaining a given level of hydraulic pressure within the hydraulic cylinders. On the other hand, upon energization, valve bodies in the flow-path-switching electromagnetic valves 41, 42 are displaced to the left, thereby allowing the communication between the pressure supply pipe 23 and pipes 21, 21'. When the plungers 11, 12, 12, 12', 12' are lowered to their bottom dead centers, then the valve bodies are displaced to the right in the direction opposite to the aforesaid direction, thereby switching the pipes in the reverse direction. In other words, the pressure supply pipe 23 is brought into communication with the pipes 22, 22', while the pressure discharge pipe 24 is communicated with the pipes 21, 21'.

Shown at 55 is a select switch which is provided with contacts A to F in correspondence with the sizes of molding flasks A to F as shown in FIG. 3. Connected to the terminals of respective contacts thereof is an operation power source circuit which is adapted to energize the respective flow-path-switching electromagnetic valves 41-47 for plungers to be lowered, depending on the sizes of molding flasks. For instance, connected to the contact A for the molding flask size A are operation power source wires 56, 57, shown in broken line in FIG. 4, adapted to energize the flow-path-switching electromagnetic valves 41, 42 for plungers 11, 12, 12, 12', 12' to be lowered commensurate with the size of a molding flask so that when an arm 58 of a select switch 55 is rotated to a position A, the flow-path-switching electromagnetic valves 41, 42 alone may be energized. Connected to the other contacts B to F are operation power source circuits adapted to energize respective flow-path-switching electromagnetic valves for plungers to be lowered, depending on the molding flask sizes B to F, although they are not shown.

Description will now be turned to the operations of the aforesaid hydraulic circuits.

During an interrupted phase of an operation, a hydraulic pressure in the preceding operation is retained in lower chambers in all hydraulic cylinders, and thus all plungers remain in their raised positions. For a shakeout operation of molds using a molding-flask size A, the arm 58 in the select switch 55 is rotated to a position of A contact. Then, flow-path-switching electromagnetic valves 41, 42, which are connected to the contact A, alone are energized, so that the valve bodies are displaced to the left as shown, and thus a high hydraulic pressure built up in the hydraulic pump 49 is applied from the pressure discharge chamber 30 by way of the pressure supply pipe 23 to the flow-path-switching electromagnetic valves 41, 42 alone, so that pressure oil is fed from the flow-path-switching electromagnetic valve 42 by way of pipe 21', collector 31, and pipe 21 to the upper chambers in the hydraulic cylinders 5, 5, 5', 5', while pressure oil is supplied from the other flow-path-switching electromagnetic valve 41 by way of the pipe 21 to the upper chamber in the hydraulic cylinder 4. At the same time, a hydraulic pressure oil retained in the lower chambers in the hydraulic cylinders 5, 5, 5', 5' is discharged by way of the pipe 22, collector 32, pipe 22', flow-path-switching electromagnetic valve 42 and discharge pipe 24 into oil reservoir 48', while a hydraulic pressure oil retained in the lower chamber in the hydraulic cylinder 4 is discharged by way of the pipe 22, flow-path-switching electromagnetic valve 41 and pressure discharge pipe 24 to the oil reservoir 48'.

The supply of pressure oil in this manner causes the pistons 20 in the hydraulic cylinders 4, 5, 5, 5', 5' to be lowered alone with the plungers 11, 12, 12, 12', 12', so that their pressing pieces 11*p*, 12*p*, 12*p*, 12'*p*, 12'*p* press a mold to collapse same. When the plungers 11, 12, 12, 12', 12' are lowered to their bottom dead centers, then the upper chambers in the hydraulic cylinders are filled with pressure oil, so that the flow of pressure oil is interrupted, resulting in build-up of a pressure in the pressure supply pipe 23. By utilizing the aforesaid pressure, the energizing direction of the flow-path-switching electromagnetic valves may be reversed by means of a pressure switch 52 connected to the pressure supply pipe 23. Thus, the flow-path-switching electromagnetic valves 41, 42 cause the valve bodies to be shifted to the right according to the actuation of the pressure switch 52 in a direction opposed to that shown in the drawing. Then, high pressure oil is supplied from the discharge chamber 30 by way of the supply pipe 23, flow-path-switching electromagnetic valve 42, pipe 22', collector 32, and pipe 22 to the lower chambers in the hydraulic cylinders 5, 5, 5', 5', while the pressure oil is supplied from the discharge chamber 30 by way of the supply pipe 23, flow-path-switching electromagnetic valve 41, and pipe 22 to the lower chamber in the hydraulic cylinder 4. At the same time, pressure oil in the upper chambers in the hydraulic cylinders 4, 5, 5, 5', 5' is discharged through the pipe 21 by way of the flow-path-switching electromagnetic valves 41, 42 and then through the discharge pipe 24 into the oil reservoir 48'. The aforesaid supply of pressure oil causes the pistons in the hydraulic cylinders 4, 5, 5, 5', 5' to be lifted along with the plungers 11, 12, 12, 12', 12'. When the molding flask is delivered out after a shakeout operation and then a subsequent mold is brought under the plungers, then the flow-path switching electromagnetic valves 41, 42 are switched as shown in the drawing, according to the actuation of the pressure switch 52, so the aforesaid operational cycle is repeated.

Description has been given of a shake-out operation for the molding-flask size A. However, for the other molding-flask sizes, the hydraulic cylinders for plungers to be lowered will follow the operations as in the previous case, and hence detailed description will not be given herein.

Since a body proper of a shake-out machine is of the aforesaid arrangement, there should not be imposed any limitation on the size of a molding flask, thus allowing the use of various kinds of molding flasks. In addition, the plungers press the corner portions of the molding flask, as well, so that no sand is retained in the corner portions. In addition, even in case a plurality of castings are placed in a single molding flask, the castings may be readily separated from the molding flask, unlike the prior art. Still furthermore, plungers are lowered by using a static pressure, thus minimizing noise, dust, and vibrations, with the accompanying improvements in operational circumstance and operational efficiency.

Description will now be given of the mold feeding means.

As shown in FIG. 2, the mold feeding means or device comprises a wheeled panel 64 adapted to run on rails 63 for bringing a mold 61 under plungers, and a load reducing means 66 for reducing a load to be incurred, upon a shake-out operation. The wheeled panel 64 is provided with an opening. The wheeled panel 64 mounting a mold 61 thereon is moved to a shake-out position under plungers by means of a wheeled-panel-drive cylinder means 67, after which the surface of the mold 61 is pressed with plungers in the hydraulic cylinders so as to separate a casting and sand from a molding flask 62 and then drop same into a delivery box 84 disposed in a pit 81 therebelow.

FIGS. 5 to 8 show the detailed construction of a load reducing means for use in the mold feeding means.

Rails 63 (FIG. 1) are fixedly laid on the floor with a portion of the rails 63 positioned under the hydraulic cylinders in a shake-out machine body being separated from the other portion of rails 63 so as to form separated rails 63' which may be lifted or lowered.

Figure 7:
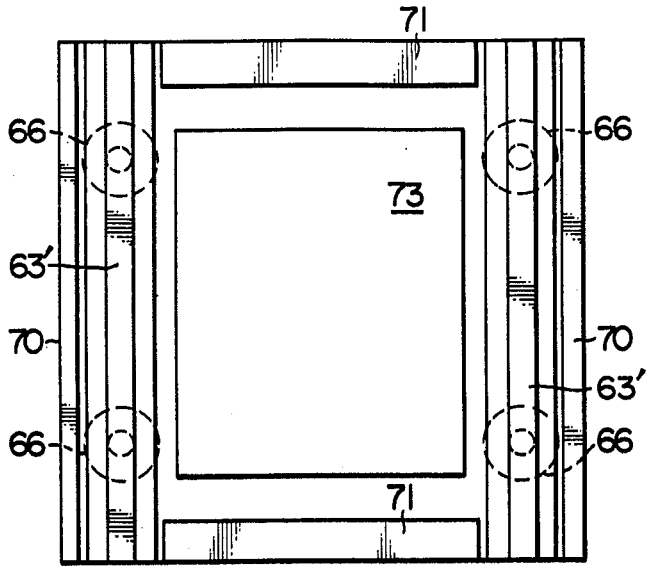
FIG. 7 is a plan view of FIG. 6.
Figure 8:
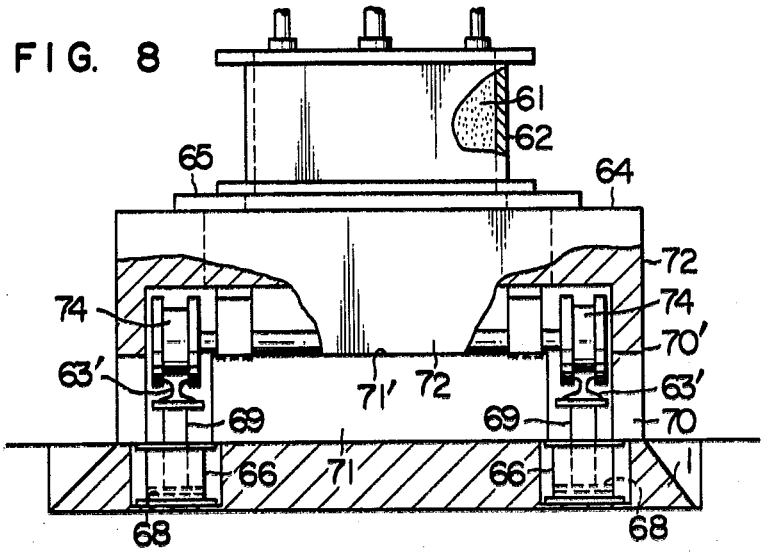
FIG. 8 is a front view of a mold feeding means, in which a portion of rails separated is lowered.

As shown in FIG. 7, a plural number of, for example, four cylinder means 66 are provided and adapted to lift or lower the separated rails 63'. The cylinder means 66 are mounted on the base 1 under the separated rails 63' and support the undersurfaces of the separated rails 63' on the tops of the plungers 69 integral with the pistons 68. Shown at 70, 71 are supporting frames which have supporting surfaces 70' and 71' adapted to contact the undersurface of the frame 72 of the wheeled panel 64, and are provided outwardly of the pair of separated rails 63', while supporting frames 71, 71 are disposed inwardly of the pair of separated rails 63' therebetween so as not to interfere with dropped materials and an opening 73 defined in the base 1.

In addition, when the separated rails 63' are held in the same plane as that of stationary rails 63, the supporting frames 70, 71 are so designed as to keep the supporting surfaces 70', 71' away from the undersurfaces of the frame 72 of the wheeled panel 64. When the separated rails 63' are lowered and the frames 72 of the wheeled panel contact the supporting surfaces 70', 71', the supporting frames 70, 71 support the wheeled panel 64.

Figure 5:
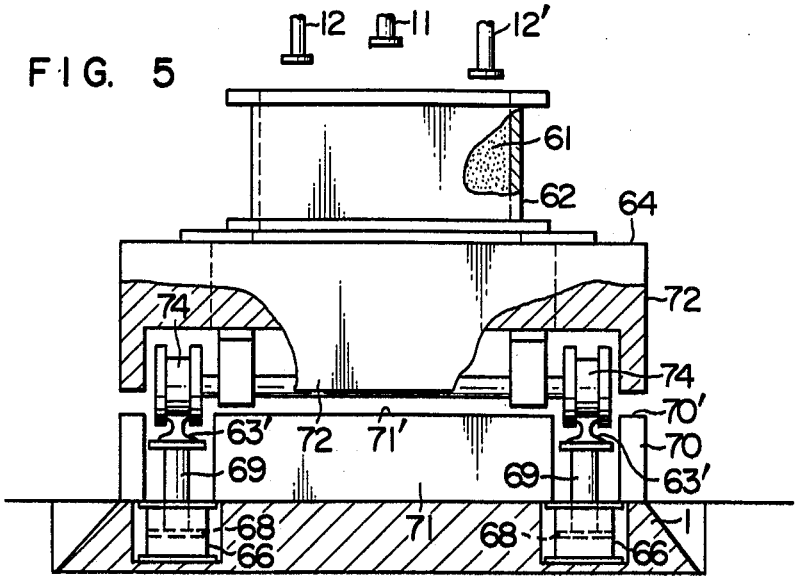
FIG. 5 is a front view of a mold feeding means.
Figure 6:
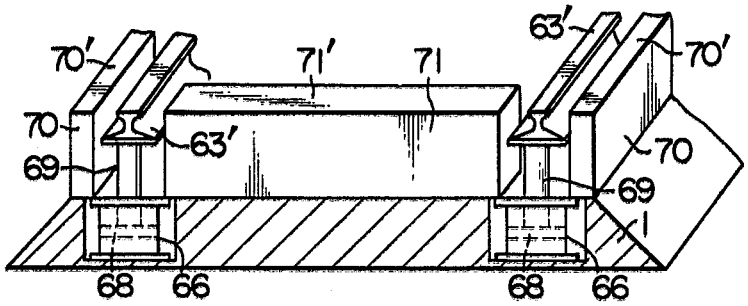
FIG. 6 is a perspective view showing a portion of rails separated, hydraulic cylinders supporting the rails, and a supporting frame portion for supporting a wheeled panel in a load-reducing means provided in a mold feeding means.

In operation, the wheeled panel 64 mounting the mold 61 prior to the shake-out operation is moved under the plungers 11, 12, 12' by the cylinder means 67, as shown in FIG. 2. In other words, as shown in FIGS. 2 and 5, the wheeled panel 64 is positioned on the separated rails 63'. Then, a pressure is applied to the upper chamber of the piston 68 in the rail lifting and lowering cylinder means 66, thereby lowering the piston 68 and plunger 69. Then, the separated rails 63' supported by the plunger 69 are lowered, so that the undersurfaces of the frames 72 of the wheeled panel 64 contact the supporting surfaces 70', 71' of the supporting frames 70, 71, and thus the wheeled panel 64 may be supported on the supporting frames 70, 71 so that the separated rails 63' may be detached from the wheels 74 of the wheeled panel.

Then, the plungers 11, 12, 12' for a shake-out operation are lowered so as to press the surface of the mold 61 on the wheeled panel 64, so that a casting and sand may be knocked out from the molding flask 62. At this time, a large load is exerted on the wheeled panel 64. However, the wheeled panel 64 is supported on the supporting frames 70, 71, so that the aforesaid load may be absorbed by the supporting frames 70, 71.

Accordingly, the aforesaid load will not be applied to the wheels 74 of the wheeled panel 64 nor to the rails 63, 63'. Upon the completion of a shake-out operation, a hydraulic pressure is applied to the lower chamber of the piston 68 in the cylinder means 66 so as to lift the pistons 68 and plungers 69. This causes the separated rails 63' to be lifted. When the wheels 74 of the wheeled panel 64 contact the rails 63', then the wheeled panel 64 is mounted on the separated rails 63', while the frames 72 of the wheeled panel are detached from the supporting surfaces 70', 71' of the supporting frames so as to be returned to a condition shown in FIG. 5, again. In other words, the separated rails 63' are brought onto the same plane as that of the stationary rails 63, and then the wheeled panel 64 runs on the separated rails 63' and stationary rails 63 outside the machine.

Meanwhile, the supporting frames 70, 71 are positioned outwardly of the rails 63' and inwardly of the separated rails 63' therebetween. However, the supporting frames may include either the supporting frames 70 disposed outwardly of the pair of separated rails 63' or the supporting frames 71 disposed inwardly of the separated rails 63' therebetween.

The mold feeding means is provided with a load reducing means of the foregoing arrangement, so that a load to be applied to the wheeled panel in a shake-out operation may be borne by the supporting frames disposed on the base along the rails, so that the load will not be applied to the wheels of a wheeled panel nor to the rails, during a shake-out operation. Accordingly, the construction of wheeled panel and rails should not be consolidated and special type materials need not be used therefor, thus leading to reduction in manufacturing cost.

The dropped material delivery means will be described hereunder.

Figure 9:
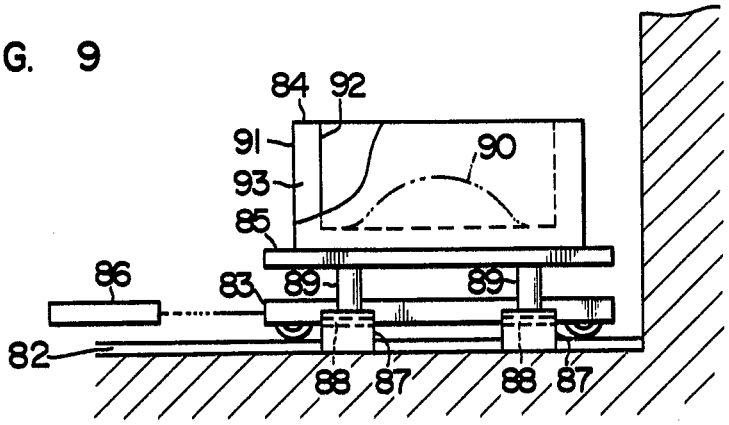
FIG. 9 is a side view of a dropped material delivery means and an impact absorbing means provided in the dropped material delivery means, in which a delivery box is lifted from a wheeled panel.

The dropped material delivery means, as shown in FIGS. 1, 2 and 9, consists of rails 82 laid on the bottom portion of a pit 81 under the shake-out machine, wheeled panel 83 adapted to run on rails 82, a hydraulic cylinder 86 adapted to drive a delivery box 84 mounted on a wheeled panel 83 through the medium of a supporting plate 85, a wheeled panel, and an impact absorbing means according to the present invention.

The impact absorbing means comprises a plural number of air cylinders 87, for examples, four in number, adapted to lift the delivery box 84 from a wheeled panel 83 through the medium of the supporting plate 85 and are positioned in the vicinity of the both sides of the rails 82 immediately under the plungers 11 to 14 for use in a shake-out operation.

Each air cylinder 87 houses a piston 88 therein, while an upwardly movable plunger 89 is connected to the piston 88.

In operation, when the delivery box 84 mounted on the wheeled panel 83 through the medium of the supporting plate 85 is brought to a given position by means of the hydraulic cylinder means 86, compressed air is then fed into the lower chamber of the piston 88 in the air cylinder 87 as shown in FIG. 2, so that the piston 88 is lifted, with the result that the delivery box 84, along with the supporting plate 85, is lifted from the wheeled panel 83 by means of the plungers 89 integral with the pistons 88, as shown in FIG. 9. When the delivery box 84 is maintained in the aforesaid condition, a casting and sand 90 knocked out from the molding flask 62 are dropped into the delivery box 84, according to a shake-out operation.

In this case, a considerably large impact should have been experienced. However, the delivery box 84 is supported on the plungers 89 of the air cylinders 87, so that an impact may be absorbed by compressed air retained in the lower chambers of the pistons 88.

Then, compressed air retained in the lower chambers of the pistons 88 in the air cylinders 87 is discharged so as to lower a lifting force thereof, and then the pistons 88 and plungers 89 are lowered as shown in FIG. 2, so that the delivery box 84 may be mounted on the wheeled panel 83 through the medium of the supporting plate 85. The wheeled panel 83 is drawn by the hydraulic cylinder means 86 to a position where dropped materials are to be taken out from the delivery box 84.

The dropped material delivery means is provided with an impact absorbing means of the aforesaid arrangement, so that an impact incurred to a casing and delivery box may be positively absorbed, when a casting and sand are dropped from a considerable height, during the shake-out operation, so that a cracking in the casting and deformation in the delivery box may be avoided.

Furthermore, the aforesaid delivery box 84 is of a double wall construction consisting of inner steel plates and outer steel plates, as far as the bottom and peripheral sides of the box are concerned, with a buffer material filled between the inner and outer steel plates.

As shown in FIG. 9, the bottom and side portions of the delivery box 84 are spaced apart from each other so as to provide a double wall construction. In this respect, buffer materials 93 such as waste casting sand are filled between the outer steel plate 91 and the inner steel plate 92.

With the delivery box 84 of the aforesaid arrangement, when the casing and sand are dropped into the delivery box, shock and sound may be absorbed thereby, and there may be avoided sounds, deformation of delivery box, cracking in castings and the like.

The shake-out operation according to the shake-out machine of the aforesaid arrangement will be described according to the operational sequence of the respective cylinder means.

The table below shows the operational sequence of the respective cylinder means.

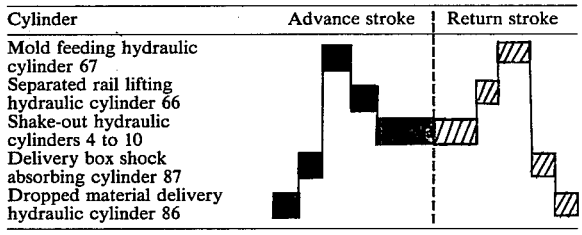

More particularly, a delivery wheeled panel 83 is shifted to a given position for a shake-out operation by means of the dropped-material delivery hydraulic cylinder 86. Then, the delivery box 84 is lifted from the delivery wheeled panel 83 by means of the impact absorbing air cylinder 87. The wheeled panel 64 in the mold feeding means is then shifted. The mold 61 mounted on the wheeled panel 64 is moved to a given position for a shake-out operation by means of the hydraulic cylinder 67. Then, separated rails 63' are lowered by means of lifting hydraulic cylinder 66, so that the frames 72 of the wheeled panel 64 are supported on the supporting frames 70, 71. Desired hydraulic cylinders of the shake-out hydraulic cylinders 4, 5, 5', 6, 6', 7, 7', 8, 8', 9, 9' to 10 are operated, commensurate with the size of molding flasks, so that the plungers are lowered so as to knock out a casting and sand from the molding flask. Then, on the return stroke, the operational sequence for the advance stroke is reversed, so that the respective cylinder means may be returned to their initial positions in preparation for the subsequent shake-out operation.

What is claimed is:

1. A shake-out machine for use with a self-curing mold, the shake-out machine comprising:

a body member provided with a bridge-shaped frame, a plurality of hydraulic cylinder means disposed on the top of a ceiling portion of said frame;

a downwardly directed plunger provided at each hydraulic cylinder means;

mold feeding means operatively associated with the body member and including a wheeled panel having an opening, said wheeled panel being movably mounted on rails laid on a floor so as to transport a mold under said plungers, said wheeled panel acting as a supporting mount for a molding flask during a shake-out operation;

a dropped material delivery means operatively associated with the body member and including a wheeled panel, said last-mentioned wheeled panel being movably mounted on rails laid on a bottom portion of a pit provided in the floor, and a delivery box mounted on said last-mentioned wheeled panel; and means operatively connected with said hydraulic cylinder means for operating said hydraulic cylinder means independently of each other such that desired plungers in said hydraulic cylinder means may be lowered in dependence upon a size of a molding flask.

2. A shake-out machine for use with a self-curing mold, as set forth in claim 1, further comprising:

a plurality of first pipes with each pipe of said plurality communicating with an upper chamber of each of the hydraulic cylinder means;

a plurality of second pipes with each pipe of said plurality of second pipes communicating with a lower chamber of each of the hydraulic cylinder means;

pressure medium supply pipes connected between said hydraulic cylinder means and; a hydraulic pump for supplying a pressure medium to the hydraulic cylinder means;

pressure medium discharge pipes operatively connected to said hydraulic cylinder means for discharging pressure medium from the hydraulic cylinder means to oil reservoirs;

flow-path-switching electromagnetic valve means operatively associated with said pipes for controlling a flow of pressure medium to the hydraulic cylinder means, said electromagnetic valve means, in a de-energized condition, shut off a supply of pressure medium from the pressure medium supply pipes to the hydraulic cylinder means and, in an energized condition, allow communications between said pressure medium supply pipes and said first pipes and between said pressure medium discharge pipes and said second pipes; and means operatively associated with said electromagnetic valve means for effecting switching of a flow pattern of the pressure medium to the hydraulic cylinder means when the plungers in said hydraulic cylinder means reach a bottom dead center position.

3. A shake-out machine for use with a self-curing mold, as set forth in claim 2, wherein said means for effecting a switching of a flow pattern includes pressure switch means for detecting a predetermined pressure of the pressure medium in the pressure supply pipes whereby a switching of the flow pattern is effected upon a detection of the predetermined pressure.

4. A shake-out machine for use with a self-curing mold, as set forth in claim 2, wherein said hydraulic cylinder means are grouped into a plurality of individual blocks commensurate with sizes of molding flasks, and wherein a single flow-path-switching electromagnetic valve means is provided for controlling a flow of pressure medium between all the hydraulic cylinder means of a block and the pressure medium supply pipes.

5. A shake-out machine for use with a self-curing mold, as set forth in claim 3, wherein an operation power source circuit means are operatively associated with said electromagnetic valve means, for controlling an energization of the electromagnetic valve means of a block of hydraulic cylinder means which are to become effective in dependence upon a size of a molding flask; and a select switch means is operatively connected with the operation power source circuit means, said select switch means including switch contacts corresponding to the size of a molding flask.

6. A shake-out machine for use with a self-curing mold, the shake-out machine comprising:

a body member provided with a bridge-shaped frame;

a plurality of hydraulic cylinder means disposed on a top of a ceiling portion of said frame;

a downwardly directed plunger provided at each hydraulic cylinder means;

mold feeding means operatively associated with the body member and including a wheeled panel having an opening, said wheeled panel being movably mounted on rails laid on a floor so as to transport a mold under said plungers, said wheeled panel acting as a supporting mount for a molding flask during a shake-out operation;

dropped material delivery means operatively associated with said body member and including a wheeled panel, said last-mentioned wheeled panel being movably mounted on rails laid on a bottom portion of a pit provided in the floor, and a delivery box mounted on said last-mentioned wheeled panel; and a load reduction means provided at said mold feeding means, said load reduction means including a pair of selectively displaceable rails disposed under said plungers, a plurality of cylinder means operatively connected with said displaceable rails, and supporting frame means for supporting a frame of the wheeled panel of said mold feeding means when said displaceable rails are in a lowered position, said supporting frame means being positioned outwardly of the displaceable rails or between both of said displaceable rails.

7. A shake-out machine for use with a self-curing mold, as set forth in claim 6, wherein the cylinder load reduction means each include a position means and a plunger means integrally formed on the piston means, and wherein said cylinder load reduction means are arranged under each of said displaceable rails in a manner such that said displaceable rails are supported on said plunger means, said plunger means protruding upwardly from said cylinder load reduction means.

8. A shake-out machine for use with a self-curing mold, the shake-out machine comprising:

a body member provided with a bridge-shaped frame;

a plurality of hydraulic cylinder means disposed on top of a ceiling portion of said frame;

a downwardly directed plunger provided at each hydraulic cylinder means;

mold feeding means operatively associated with the body member and including a wheeled panel having an opening, said wheeled panel being movably mounted on rails laid on a floor so as to transport a mold under said plungers, said wheeled panel acting as a supporting mount for a molding flask during a shake-out operation;

dropped material delivery means operatively associated with said body member and including a wheeled panel, said last-mentioned wheeled panel being movably mounted on rails laid on a bottom portion of a pit provided in the floor in an area beneath the plungers of the hydraulic cylinder means, and a delivery box mounted on said last-mentioned wheeled panel; and impact absorbing means provided at said dropped material delivery means, said impact absorbing means including a plurality of air cylinder means positioned close to a portion of the rails laid on the bottom portion of the pit, which is immediately under the plungers such that a delivery box mounted on the wheeled panel of the dropped material delivery means may be lifted from said last-mentioned wheeled panel by means of said air cylinder means.

9. A shake-out machine for use with a self-curing mold, as set forth in claim 8, wherein two air cylinder means are positioned outwardly of each of said rails in the bottom portion of the pit in a spaced relation thereto, each of said air cylinder means including a plunger integrally formed with a piston housed in an air cylinder with the last-mentioned plungers projecting upwardly from the air cylinder such that a delivery box may be lifted from said wheeled panel of said dropped material delivery means by a supporting plate arranged on said lastmentioned wheeled panel.

10. A shake-out machine for use with a self-curing mold, as set forth in claim 8, wherein said delivery box is of a double wall construction and includes inner and outer steel plates which are spaced apart, and wherein one of a buffer material or shock absorbing material is filled in the spaces between the inner and outer steel plates.

11. A shake-out machine for use with a self-curing mold, as set forth in claim 10, wherein said buffer or shock absorbing material is waste casting sand.

* * * * *